United States Patent [19]

Yamamoto et al.

[11] Patent Number: 4,588,378

[45] Date of Patent: May 13, 1986

[54] CONTINUOUS HEAT TREATING FURNACE FOR METALLIC STRIP

[75] Inventors: Tadashi Yamamoto, Takarazuka; Masato Nagata, Ikoma; Tomoyuki Oba, Toyonaka, all of Japan

[73] Assignee: Chugai Ro Co., Ltd., Osaka, Japan

[21] Appl. No.: 671,631

[22] Filed: Nov. 15, 1984

[30] Foreign Application Priority Data

Nov. 18, 1983 [JP] Japan ..... 58-218313

[51] Int. Cl.[4] ..... F27B 9/28; F27B 9/14

[52] U.S. Cl. ..... 432/59; 432/152; 432/144; 432/146

[58] Field of Search ..... 432/59, 8, 78, 128, 432/130, 144, 152

[56] References Cited

U.S. PATENT DOCUMENTS

| | | | |
|---|---|---|---|
| 2,181,738 | 11/1939 | Otis | 432/59 |
| 2,294,019 | 8/1942 | Boyle . | |
| 2,296,806 | 9/1942 | Buckholdt | 432/10 |
| 3,265,033 | 8/1966 | Tonze et al. | 432/152 |
| 3,437,321 | 4/1969 | Wilkinson | 432/8 |
| 3,874,091 | 4/1975 | Fukumoto | 432/146 |
| 3,923,449 | 12/1975 | Brock | 432/59 |
| 4,449,921 | 5/1984 | Catallo | 432/8 |
| 4,474,496 | 10/1984 | Rocheleau | 432/59 |
| 4,478,573 | 10/1984 | Kitayama et al. | 432/124 |

FOREIGN PATENT DOCUMENTS 55-94442 7/1980 Japan .

*Primary Examiner*—Henry C. Yuen
*Attorney, Agent, or Firm*—Jackson & Jones

[57] ABSTRACT

A continuous heat treating furnace in which independent sectioned chambers are provided at least in part of a pre-heating/pre-cooling zone in the furnace body, with a cooler or heater being provided in suction ducts of the sectioned chambers so as to rapidly heat or cool the metallic strip through operation of dampers disposed in the suction ducts, thus making it possible to alter heat curves as required for heat treatment of various metallic strips.

3 Claims, 10 Drawing Figures

CONTINUOUS HEAT TREATING FURNACE FOR METALLIC STRIP

BACKGROUND OF THE INVENTION

The present invention generally relates to a heat treating process and more particularly, to a continuous heat treating furnace for heat-treating a metallic strip and the like therein.

Conventionally, in the continuous heat treating furnaces for a metallic strip, etc., heat treatment is effected by heating and soaking the metallic strip at a predetermined temperature and cooling said metallic strip thereafter, but heat discharged from the metallic strip during the cooling thereof is undesirably dissipated into the atmosphere at it is, without being utilized, thus resulting in a loss of energy to a large extent.

Accordingly, in order to prevent the loss of energy in the continuous heat treating furnace for a metallic strip as referred to above, there has been proposed, in Japanese Patent Application Tokugansho No. 58-112328 assigned to the same assignee as the present invention, a continuous heat treating furnace for a metallic strip, which comprises a furnace body, a heat exchanging zone (pre-heating/pre-cooling zone) for pre-heating and pre-cooling the metallic strip, and a heating/soaking zone for heating and soaking the metallic strip, said heat exchanging zone and heating/soaking zone being provided within the furnace body by dividing the interior of said furnace body with a partition wall disposed in a direction of width of the furnace body so as to transport the metallic strip in a confronting state through the heat exchanging zone, said heat exchanging zone being provided with nozzle means for jetting atmospheric gas of the heat exchanging zone onto opposite surfaces of said metallic strip being transported, an atmosphere supply duct means for the nozzle means, and a circulation fan for utilizing heat dissipated from the metallic strip during pre-cooling for pre-heating the metallic strip in order to achieve energy saving.

In the continuous heat treating furnace for the metallic strip as described above, however, the control of heat curves is to be effected through an increase or decrease of heat conductivity by the adjustment of air flow of the circulating fan, and such an increase or decrease is limited in itself, thus making it impossible to fully cope with the situation in the case where a rapid cooling or heating is required depending on the kind of the metal of the strip.

SUMMARY OF THE INVENTION

Accordingly, an essential object of the present invention is to provide an improved continuous heat treating furnace for a metallic strip, which is capable of coping with alterations of heat curves to a large extent, while achieving a saving of energy.

Another important object of the present invention is to provide an improved continuous heat treating furnace for a metallic strip of the above described type, which is simple in construction and highly reliable in functioning.

In accomplishing these and other objects, according to one preferred embodiment of the present invention, there is provided a continuous heat treating furnace for a metallic strip, which comprises a furnace body, a pre-heating/pre-cooling zone, i.e., a heat exchanging zone, for pre-heating and pre-cooling the metallic strip, and a heating/soaking zone for heating and soaking the metallic strip. The pre-heating/pre-cooling zone are provided within the furnace body by dividing the interior of the furnace body with a partition wall disposed in a direction of width of the furnace body so as to transport the metallic strip in a confronting state through the pre-heating/pre-cooling zone. The pre-heating/pre-cooling zone is further divided into at least one sectioned preheating chamber and at lease one sectioned pre-cooling chamber by partition walls and provided in the widthwise and lengthwide directions of the furnace body. The sectioned pre-heating chamber is provided therein with a circulation fan for a jet stream nozzle header, with a sectioned pre-heating chamber atmosphere suction duct having a heater and a sectioned pre-cooling atmosphere suction duct being connected to a suction side of said circulation fan. The sectioned pre-cooling chamber is provided therein with another circulation fan for a jet stream nozzle header, with a sectioned pre-cooling chamber atmosphere suction duct and a sectioned pre-heating chamber atmosphere suction duct being connected to a suction side of the another circulation fan. The suction ducts described above are respectively provided therein with open/close dampers for alteration of the atmosphere circulating passage through operation thereof.

By the arrangement of the present invention as described above, an improved continuous heat treating furnace has been advantageously provided, with a substantial elimination of disadvantages inherent in the conventional heat treating furnaces of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
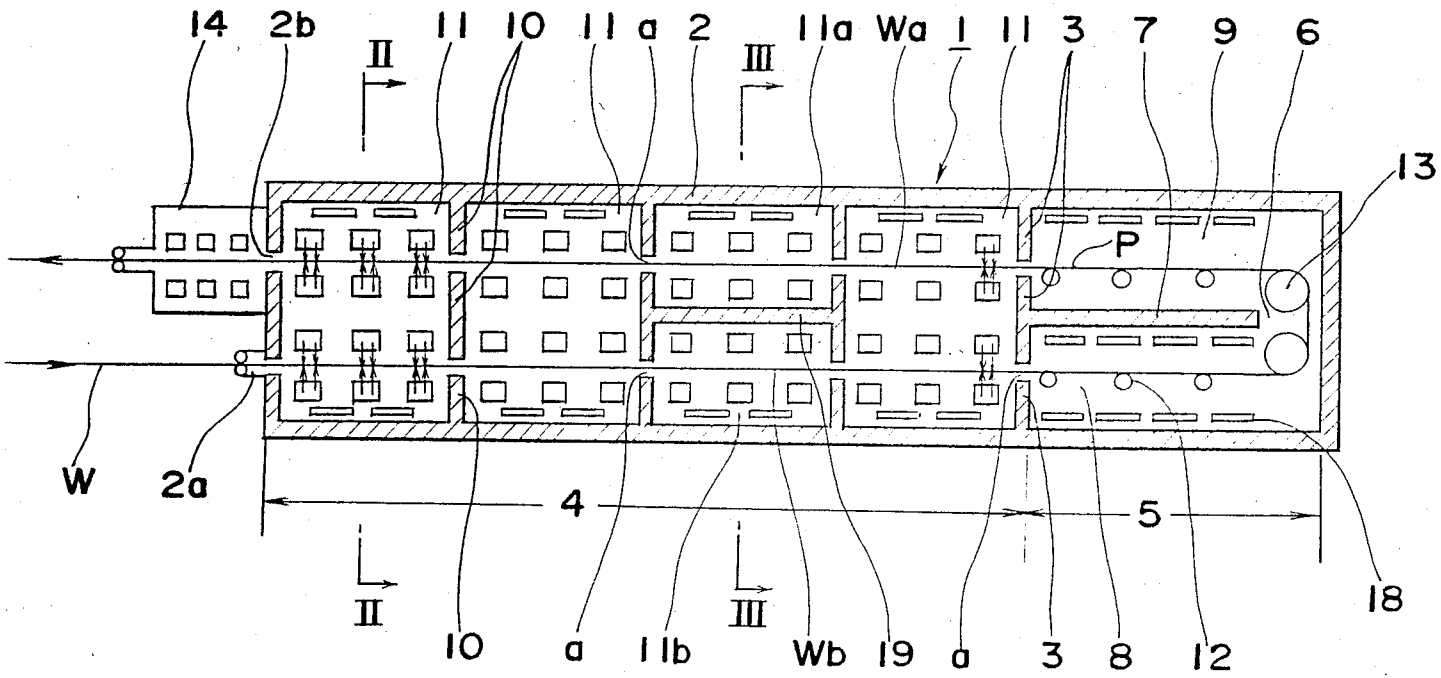
FIG. 1 is a schematic side sectional view of a continuous heat treating furnace for a metallic strip according to one preferred embodiment of the present invention.

Before the description of the present invention proceeds, it is to be noted that like parts are designated by like reference numerals throughout the accompanying drawings.

Referring now to the drawings, there is shown in FIG. 1, a heat treating furnace 1 for heat treating a metallic strip according to one preferred embodiment of the present invention. The heat treating furnace 1 includes a housing or a furnace body 2 of a refractory material which is divided by a partition wall 3 provided in a direction of width of the furnace 1, into a heat exchanging zone 4, i.e., pre-heating/pre-cooling zone, for pre-heating the metallic strip and also for cooling the metallic strip after heating and soaking thereof, and a heating/soaking zone 5 for subjecting the metallic strip to the heating and soaking. The heating/soaking zone 5 is divided into a heating chamber 8 and a soaking chamber 9 by a section wall 7 provided therein in the lengthwise direction of the furnace 1 except for a space 6 at the end portion thereof, while the heat exchanging zone 4 is further divided into a plurality of heat exchanging chambers, i.e., pre-heating/pre-cooling, chambers 11 by corresponding section walls 10 provided therein in the widthwise direction of the furnace 1. Moreover, one of the pre-heating/pre-cooling chambers 11 is further divided into a sectioned pre-cooling chamber 11*a* and a sectioned pre-heated chamber 11*b* by a partition wall 19 provided in the longitudinal direction of the furnace 1. It is to be noted, however, that the section wall 7, and the section walls 10 other than the section wall 10 for the formation of the sectioned pre-cooling chamber 11*a* and the sectioned pre-heating chamber 11*b* as described above, need not necessarily be provided.

The metallic strip W is transported in the direction indicated by an arrow through a U-shaped path P formed along a charge port 2*a*, openings "a" provided in the section walls 10 and the partition wall 3, support rolls 12 and direction changing rolls 13 rotatably provided in the heating/soaking zone 5, and a discharge port 2*b* of the furnace 1 so as to be subjected to the heat treatment by being pre-heated at the lower portion of the pre-heating/pre-cooling chambers 11, further being heated up to a predetermined temperature at the heating/soaking zone 5, and then, being pre-cooled at the upper portion of the chambers 11 before passing through a conventional cooling zone 14 provided subsequent to the discharge port 2*b*.

Figure 2:
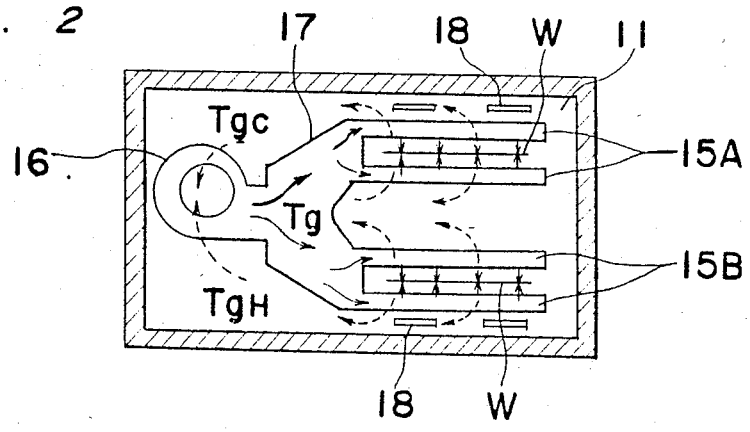
FIG. 2 is a cross section taken along the line II—II in FIG. 1.

Meanwhile, as shown in FIG. 2, each of the pre-heating/pre-cooling chambers 11 is provided therein, at positions where the partition wall 19 is not provided, with a pair of nozzle headers 15A and 15B disposed to surround the transport path P therebetween, and a common atmosphere supply duct 17 having a circulation fan 16, whereby the atmospheric gas in the chamber 11 is drawn by the circulation fan 16 for pressure raising so as to be directed through the nozzle headers 15A and 15B, onto both surfaces of the metallic strip W being transported for pre-heating or pre-cooling of the stip W and also for supporting said strip through floating.

On the other hand, in the sectioned pre-cooling chamber 11*a* and the sectioned pre-heating chamber 11*b* partitioned by the partition wall 19 as described earlier, a pair of jet stream nozzle headers 20*a* and 20*b* are provided to surround the transport path P as shown in FIG, 3, and the jet stream nozzle header 20*a* in the sectioned pre-cooling chamber 11*a* is communicated with the sectioned pre-heating chamber 11*b* by a suction duct 21*a* through a jet stream nozzle header circulation fan 22*a*, while the jet stream nozzle header 20*b* in the sectioned pre-heating chamber 11*b* is communicated with the sectioned pre-cooling chamber 11*a* by a suction duct 21*b* through a jet stream nozzle header circulation fan 22*b*. Furthermore, a suction duct 24 incorporated with a cooler 23 is provided in the sectioned pre-cooling chamber 11*a*, while a suction duct 26 incorporated with a heater 25 is provided in the sectioned pre-heating chamber 11*b*, with these suction ducts 24 and 26 being respectively connected with suction sides of the suction fans 22*a* and 22*b*. Dampers 27*a*, 27*b*, 28*a* and 28*b* are operably provided in the suction ducts 21*a*, 24, 21*b* and 26 as shown.

Subsequently, operations of the heat treating furnace having the construction as described so far will be explained hereinbelow.

In the first place, the metallic strip W is passed through the heat treating furnace 1 as shown in FIG. 1, and heaters 18 of the pre-heating/pre-cooling zone (heat exchanging zone) 4 and the heating/soaking zone 5, and the circulation fans 16, 22*a* and 22*b* are operated so as to raise the temperature in the respective pre-heating/pre-cooling chambers 11 and the heating/soaking zone 5 up to a predetermined level. It is to be noted that, in the above case, the dampers 27*a* and 28*a* are opened, while the dampers 27*b* and 28*b* are closed, with the cooler 23 and the heater 25 being shut down. When the heat treating furnace 1 reaches a state in which it can be operated, the metallic strip W is continuously transported for effecting the heat treatment, while by ensuring a steady state of operation, the heaters 18 of the pre-heating/pre-cooling zone 4 are cut off.

It is to be noted here that, although the heaters 18 for the pre-heating/pre-cooling zone 4 are intended to rapidly raise the temperature therein up to a steady temperature capable of continuous operation, such heaters 18 need not necessarily by provided, but may be omitted depending on requirements.

The metallic strip W continuously fed within the heat treating furnace 1 is transported, through the pre-heating/pre-cooling zone 4, to the heating/soaking zone 5 so as to be heated and soaked at the predetermined temperature by the heaters 18, and again, introduced into the preheating/pre-cooling zone 4, where the portion Wa of the metallic strip W heated up to a high temperature in the heating/soaking zone 5 exchanges heat with the portion Wb thereof passing through the lower portion as described later for pre-heating the lower portion Wb, and also, for being pre-cooled itself.

Figure 5:
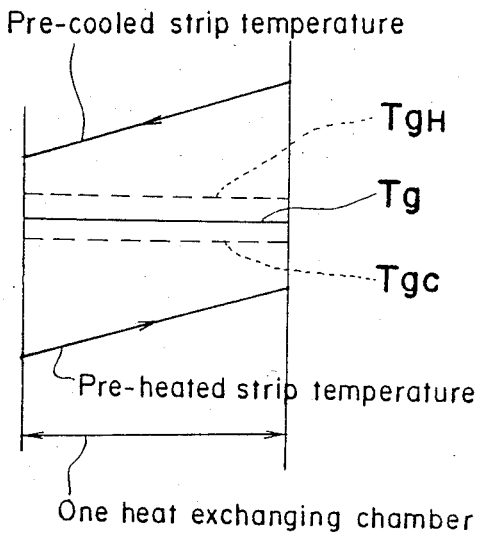
FIG. 5 is a diagram explanatory of the principle for a heat exchanging function in a heat exchanging zone in the furnace of FIG. 1.
Figure 6:
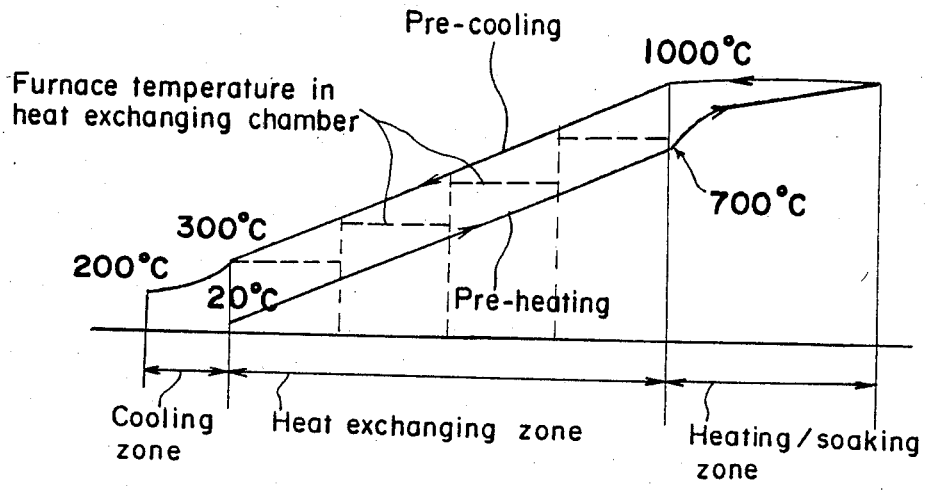
FIG. 6 is a diagram representing heat curves for the heat treating furnace of FIG. 1 during an ordinary period of operation.

More specifically, referring also to FIGS. 5 and 6, the atmospheric gas at the temperature Tg in the pre-heating/pre-cooling chamber 11 is directed onto both surfaces of the portion Wa of the strip W at a high temperature from the upper pair of nozzle header 15A by the circulation fan 16 through the duct 17 so as to absorb the usable heat from the portion Wa of the strip W, and thus is, raised in its temperature to TgH. Meanwhile, the atmospheric gas at a temperature Tg jetted from the lower pair of nozzle header 15B imparts heat to the portion Wb of the strip W, and is lowered in its temperature to TgC. Thus, the atmospheric gases at the temperatures TgH and TgC subjected to heat exchange with respect to the metallic strip W as described above are drawn by the circulation fan 16 for mixing so as to become atmospheric gas at the temperature Tg to repeat the heat exchanging in the similar manner as explained so far (FIG. 5). It is to be noted here that the heat exchanging function in the respective pre-heating/pre-cooling chambers 11 is exactly the same except that the atmospheric gas temperature Tg is gradually increased towards the side of the heating/soaking zone 5.

Accordingly, by way of example, a metallic strip W at a temperature of 20° C. charged into the treating furnace 1 from the charge port 2*a* thereof is heated and held at a temperature of 1000° C. in the heating/soaking zone 5 after having been slowly pre-heated up to a temperature of about 700° C. at the lower portion of the pre-heating/pre-cooling zone 4, and thereafter, gradually cooled down to 300° C. at the upper portion of the pre-heated/pre-cooling zne 4 so as to be introduced through the discharge port 2*b* into the conventional cooling zone 14 where said strip W is cooled down to a temperature of 200° C. for being discharged subsequently (FIG. 6).

Figure 4:
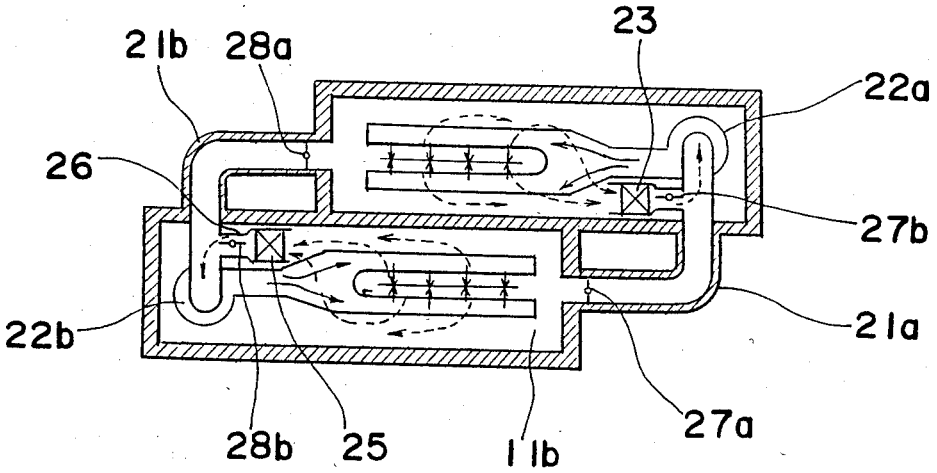
FIG. 4 is a cross section similar to FIG. 3, which particularly shows a different state of operation thereof.

Subsequently, when it is required to rapidly heat and rapidly cool metallic strips through alterations of heat curves due to changes in the kinds of steel, etc., the dampers 27*a* and 28*a* are closed, while the dampers 27*b* and 28*b* are opened, with the cooler 23 and the heater 25 being driven for operation of the furnace 1 as shown in FIG. 4. More specifically, in the above case, the sectioned pre-cooling chamber 11*a* and the sectioned preheating chamber 11*b* become independent and the atmospheric gas cooled by the cooler 23 is jetted from the nozzle header pair 15A in the pre-cooling chamber 11*a*, while the atmospheric gas heated by the heater 25 is jetted from the nozzle header pair 15B so as to rapidly cool the metallic strip Wa and to rapidly heat the metallic strip Wb.

It is to be noted here that the atmosphere circulating means and change-over means to be provided in the sectioned pre-cooling chamber 11*a* and the sectioned pre-heating chamber 11*b* are not limited to those described earlier with reference to FIG. 3, but may be modified in various ways, for example, as follows.

Figure 3:
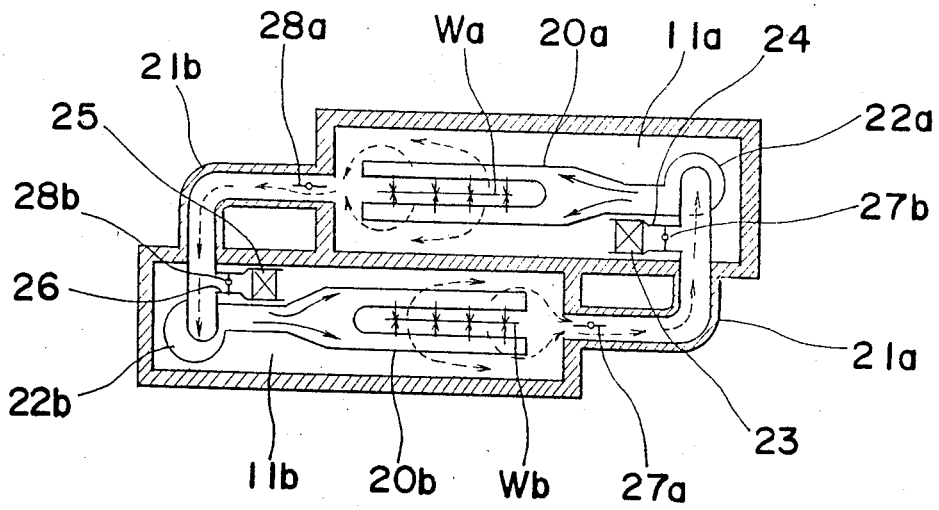
FIG. 3 is a cross section taken along the line III—III in FIG. 1.

Referring to FIGS. 7 through 10, there are shown modifications of the arrangement of FIG. 3, In each of FIGS. 7 to 10, only one side of the circulation path provided with the cooler 23 is illustrated, and it is to be understood that the circulation path at the other side is provided with the heater 25, although not particularly shown.

Figure 7:
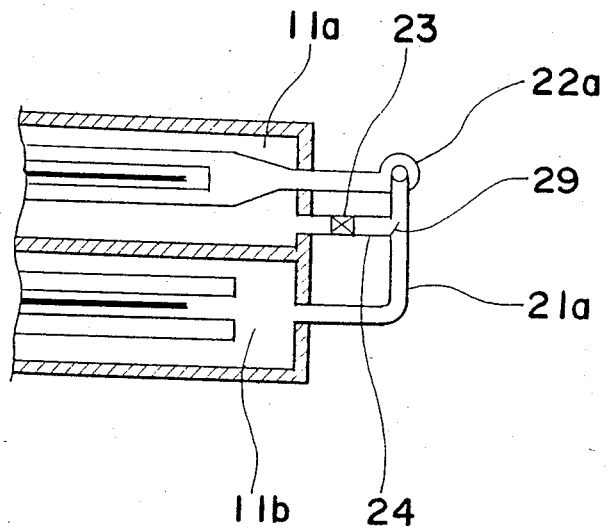
FIGS. 7 through 10 are fragmentary sectional views showing modifications of the construction of FIG. 3 on enlarged scales.
Figure 8:
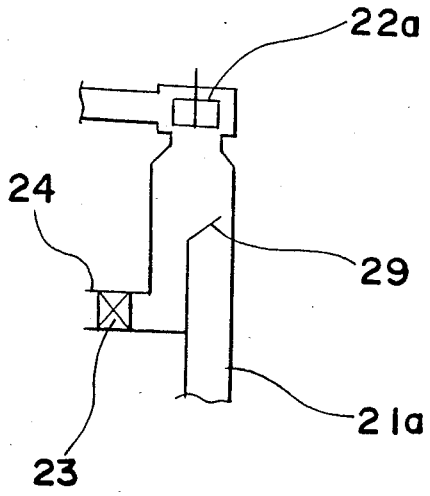
Figure 9:
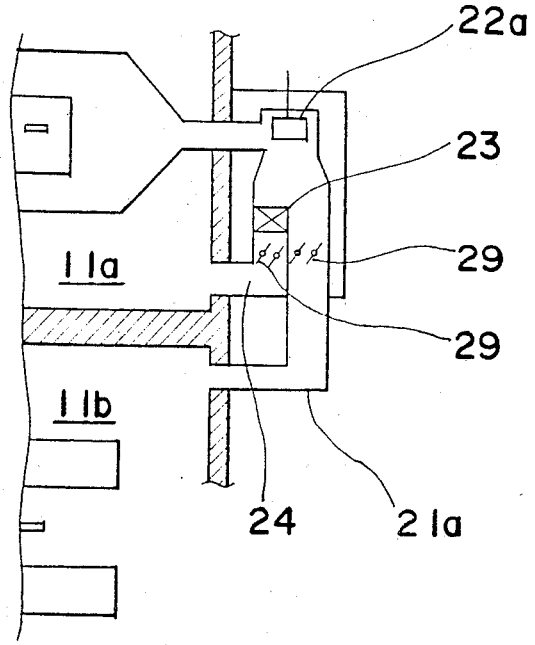
Figure 10:
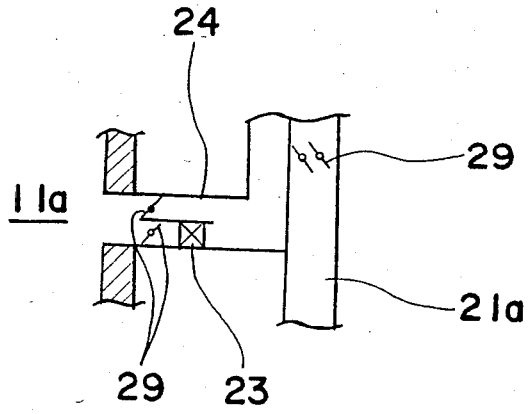

In each of the modifications of FIGS. 7 and 8, one damper 29 is provided at a confluence or junction of the suction ducts 21*a* and 24. On the other hand, in the modification of FIG. 9, a plurality of dampers 29 are provided in each of the suction ducts 21*a* and 24, which may further be modified as shown in FIG. 10 wherein the cooler 23 is provided only at one portion of the suction duct 24 so as to by-pass part of the atmospheric gas.

It should be noted here that, in the foregoing embodiments, although the present invention has been mainly described with reference to a horizontal type heat treating furnace, the concept of the present invention is not limited in its application to such a horizontal type furnace alone, but may readily be applied to a vertical type heat treating furnace as well, and that the transport means within the furnace is not limited to that as employed in the foregoing embodiments, but may be modified to a floater system, roller system, catenary system or a combination thereof over the entire zone. Moreover, the heating system in the heating/soaking zone 5 may of course be radiation heating or convection heating depending on necessity. Meanwhile, the sectioned pre-cooling chamber 11*a* and the sectioned pre-heating chamber 11*b* may be provided at any desired portions of the pre-heating/pre-cooling zone, i.e., heat exchanging zone 4.

As is clear from the foregoing description, according to the present invention, since the heat source for preheating the metallic strip is fundamentally obtained by the heat amount discharged from the metallic strip at a high temperature coming out of the heating/soaking zone, without requiring any external heat energy, the fuel unit of $25\times10^4$ Kcal/Ton at a furnace efficiency of 70% in the conventional arrangements is reduced only to $12.8\times10^4$ Kcal/Ton, with an improvement of the furnace efficiency up to 140%. Moreover, the amount of cooling water conventionally employed in the cooling zone may be decreased to a large extent.

Moreover, according to the present invention, owing to the arrangement that the independent sectioned chambers are provided at least in part of the preheating/pre-cooling zone, with the cooler or heater disposed in the suction ducts of said sectioned chambers so as to rapidly heat or cool the metallic strip through operation of the dampers, it is possible to alter heat curves as desired for heat treatment of various metallic strips.

Furthermore, owing to the structure that the preheating/pre-cooling zone is in the same space as that for the cooling zone and pre-heating zone, heat exchange due to radiation between the upper and lower portions of the metallic strip functions to improve the heating exchanging efficiency, and since only one circulation fan is suffucient for the convection heat exchange, the construction is simplified by that extent, thus resulting in the reduction of cost of the heat treating furnace.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A continuous heat treating furnace for a metallic strip which comprises:

an elongated housing (2);

a first partition wall (3) extending across the width of the elongated housing to divide the housing into a pre-cooling/pre-heating zone (4) and a heat/soaking zone (5);

a second partition wall (10) extending across the width of said housing to divide said pre-heating/-pre-cooling zone (4) into a plurality of preheating/pre-cooling chambers (11), at least one of said pre-heating/pre-cooling chambers (11) being further divided into a sectioned pre-cooling chamber (11*a*) and a sectioned pre-heating chamber (11*b*) by a section wall (19) extending in the lengthwise direction of the elongated housing;

said first and second partition walls each having a pair of metallic strip passing openings (a) therein;

a metallic strip turning means (13) located in said heating/soaking zone (5) for receiving an entering metallic strip (W), reversing its direction and exiting the metallic strip from said zone;

a first nozzle header means (20*a*) located in said precooling section and having a first circulation fan (22*a*) with an input duct and an output duct for directing atmospheric gas unto opposite surfaces of the metallic strip (Wa);

a second nozzle header means (20*b*) located in said pre-heating section (11*b*) and having a second circulation fan (22*b*) with an input and an output duct for directing atmospheric gas unto opposite surfaces of the metallic strip (Wb);

a first duct (21*b*) communicating between said pre-cooling section (11*a*) and said input duct of said second fan (22*b*) in said pre-heating section (11*b*), said first duct having an open/close damper (28*a*) located therein;

a second duct (21*a*) communicating between said pre-heating section (11*b*) and said input duct of said first circulation fan (22*a*) in said pre-cooling section (11*a*), said second duct having an open/close damper (27*a*) located therein;

a cooler means (23) located in said pre-cooling section and having an open/close damper (27*b*) located in said inlet duct which connects said cooler means with said input duct of said first circulation fan;

a heater means (25) located in said pre-heating section and having an open/close damper (28*b*) located in said inlet duct which connects said heater with said input duct of said second circulation fan; and characterized by open and closed states for said open/close dampers in said ducts for exchanging heated air from said pre-cooling section to said pre-cooling section and exchanging cooled air from said pre-heating section to said pre-cooling section or, in the alternative, for circulating air only in said pre-heating and in said pre-cooling sections when said heater means and said cooler means are operating.

2. A heat treating furnace as claimed in claim 1 wherein said first and second nozzle header means includes a pair of bifurcated nozzles connected to a common supply duct.

3. A heat treating furnace as claimed in claim 2 wherein a plurality of bifurcated nozzles are provided to respectively extend about said metallic strip traveling into said furnace and said metallic strip traveling out of said furnace.

* * * * *